US012808016B2

(12) United States Patent
Tamura et al.

(10) Patent No.: US 12,808,016 B2
(45) Date of Patent: Nov. 24, 2026

(54) GOLD ALLOY AND METHOD FOR PRODUCING GOLD ALLOY

(71) Applicant: Tokyo University of Science Foundation, Tokyo (JP)

(72) Inventors: Ryuji Tamura, Tokyo (JP); Kazuki Minami, Tokyo (JP); Hiyori Yokoyama, Tokyo (JP); Yutaro Abe, Tokyo (JP); Asuka Ishikawa, Tokyo (JP)

(73) Assignee: Tokyo University of Science Foundation, Tokyo (JP)

( * ) Notice: Subject to any disclaimer, the term of this patent is extended or adjusted under 35 U.S.C. 154(b) by 434 days.

(21) Appl. No.: 18/284,377

(22) PCT Filed: Mar. 25, 2022

(86) PCT No.: PCT/JP2022/014693
§ 371 (c)(1),
(2) Date: Sep. 27, 2023

(87) PCT Pub. No.: WO2022/210430
PCT Pub. Date: Oct. 6, 2022

(65) Prior Publication Data

US 2024/0158890 A1 May 16, 2024

(30) Foreign Application Priority Data

Mar. 29, 2021 (JP) ..... 2021-056093

(51) Int. Cl.
*C22C 5/02* (2006.01)
*C22C 1/02* (2006.01)

(52) U.S. Cl.
CPC . *C22C 5/02* (2013.01); *C22C 1/02* (2013.01)

(58) Field of Classification Search
CPC ..... C22C 5/02; C22C 1/02; C22F 1/14
See application file for complete search history.

(56) References Cited

U.S. PATENT DOCUMENTS

2009/0320967 A1 12/2009 Tsai et al.

FOREIGN PATENT DOCUMENTS

| | | | |
|---|---|---|---|
| EP | 0819773 | A1 | 1/1998 |
| JP | S60-110868 | A | 6/1985 |
| JP | 2001-316790 | A | 11/2001 |
| JP | 2003-328059 | A | 11/2003 |
| JP | 2005-113235 | A | 4/2005 |
| JP | 2008-069438 | A | 3/2008 |
| JP | 2009-191327 | A | 8/2009 |

OTHER PUBLICATIONS

Ning, Yuantao. "Properties and applications of some gold alloys modified by rare earth additions." Gold Bulletin 38.1 (2005): 3-8.*
Sep. 4, 2024 (EP) Extended European Search Report Application No. 22777586.3.
May 26, 2025 (CN) Office Action Application No. 202280026448.3.
Gebresenbut et al., "Syntheses optimization, structural and thermoelectric properties of 1/1 Tsai-type quasicrystal approximants in RE-Au-SM systems (RE = Yb, Gd and SM = Si, Ge)", J. Phys.: Condens. Matter 25 (2013) 135402, pp. 1-11.

* cited by examiner

*Primary Examiner* — Jessee R Roe
(74) *Attorney, Agent, or Firm* — Banner & Witcoff, Ltd.

(57) ABSTRACT

A gold alloy and a method for producing the gold alloy. The gold alloy includes: gold; and an Au—X-RE-based hypermaterial represented by a compositional formula $Au_{100-(a+b)}X_aRE_b$, wherein, in the compositional formula, X represents at least one atom selected from the group consisting of Al, Ga, In, Si, Ge, and Sn; RE represents a rare-earth element; and a and b respectively represent a content of X and a content of RE, expressed in at %, and satisfy the following (1) and (2): $10 \leq a \leq 40$ (1); and $13 \leq b \leq 17$ (2), wherein the Au—X-RE-based hypermaterial is dispersed in a gold matrix phase.

8 Claims, 6 Drawing Sheets

GOLD ALLOY AND METHOD FOR PRODUCING GOLD ALLOY

RELATED APPLICATIONS

This application is a National Stage Application under 35 U.S.C. 371 of co-pending PCT application PCT/JP2022/014693 designating the United States and filed Mar. 25, 2022, which claims the benefit of JP application number 2021-056093 and filed Mar. 29, 2021, each of which are hereby incorporated by reference in their entireties.

TECHNICAL FIELD

The present disclosure relates to a gold alloy and a method for producing a gold alloy.

BACKGROUND ART

Due to its beautiful brilliance and high rarity, gold has been used as a precious noble metal since ancient times, and is also the oldest metal used by humans as an ornament. Gold is rich in malleability and ductility, and can be easily processed, but is soft and easily scratched, and therefore it is necessary to increase the hardness of the gold when used as jewelry.

For example, as a method of increasing the hardness of an alloy of aluminum, which is a metal other than gold, for example, JP 2009-191327 A discloses a method for strengthening an aluminum alloy substrate, comprising forming a strengthening film on a surface of the aluminum alloy substrate, wherein the strengthening film is formed by a non-melting process using a strengthening material having a higher strength than the aluminum alloy substrate.

Further, as a high-strength aluminum alloy, JP 2008-069438 A discloses a high-strength magnesium alloy represented by a compositional formula $Mg_{100-(a+b)}Zn_aX_b$, wherein X is one or more selected from Zr, Ti, and Hf, and a and b are the contents of Zn and X, respectively, expressed in at %, and satisfy the relationships of the following formulae (1), (2), and (3):

$$a/28 \leq b \leq a/9 \quad (1)$$

$$2 \leq a \leq 10 \quad (2)$$

$$0.05 \leq b \leq 1.0 \quad (3)$$

wherein, in an Mg matrix phase, Mg—Zn—X-based quasi-crystals and their approximant crystals are dispersed in the form of fine particles.

Furthermore, JP 2005-113235 A discloses a high-strength magnesium alloy represented by a compositional formula $Mg_{100-(a+b)}Zn_aY_b$, wherein a and b are the contents of Zn and Y, respectively, expressed in at %, and satisfy the relationships of the following formulae (1) and (2):

$$a/12 \leq b \leq a/3 \quad (1)$$

$$1.5 \leq a \leq 10 \quad (2)$$

wherein $Mg_3Zn_6Y_1$ quasi-crystals and their approximant crystals as age-precipitation phases are dispersed in the form of fine particles.

SUMMARY OF INVENTION

Technical Problem

In order to increase the hardness of gold, as a material improvement method, solid solution strengthening has been conventionally commonly used in which an element such as silver or copper is mixed into gold. However, since mixing other elements into gold, that is, decreasing the gold purity (gold content) in the gold ornament, leads to a decrease in value, there is a trade-off relationship between the processability and the value of the gold ornament. Accordingly, there is a need to impart a certain degree of hardness to a gold alloy without decreasing the gold purity.

JP 2009-191327 A, JP 2008-069438 A, and JP 2005-113235 A each relate to an aluminum alloy technique, but fail to describe or suggest improving the hardness of the alloy to such an extent as to be excellent in processability without decreasing the content of the matrix phase (aluminum).

An object of an embodiment of the present disclosure is to provide a gold alloy having a high gold purity and a high hardness.

An object of another embodiment of the present disclosure is to provide a method for producing a gold alloy having a high gold purity and a high hardness.

Solution to Problem

Means for solving the problem include the following aspects.

<1> A gold alloy, comprising:

gold; and an Au—X-RE-based hypermaterial represented by a compositional formula $Au_{100-(a+b)}X_aRE_b$, wherein, in the compositional formula, X represents at least one atom selected from the group consisting of Al, Ga, In, Si, Ge, and Sn; RE represents a rare-earth element; and a and b respectively represent a content of X and a content of RE, expressed in at %, and satisfy the following (1) and (2):

$$10 \leq a \leq 40 \quad (1)$$

$$13 \leq b \leq 17 \quad (2)$$

wherein the Au—X-RE-based hypermaterial is dispersed in a gold matrix phase.

<2> The gold alloy according to <1>, wherein an Au content is 80% by mass or more with respect to a total mass of the gold alloy.

<3> The gold alloy according to <1> or <2>, wherein the rare-earth element is Sc, Y, La, Ce, Pr, Nd, Sm, Eu, Gd, Tb, Dy, or Yb.

<4> The gold alloy according to any one of <1> to <3>, wherein X is Si, and an at % ratio (a:b) of a to b is 8:7.

<5> The gold alloy according to any one of <1> to <3>, wherein X is Ge, and an at % ratio (a:b) of a to b is 9.5:7.

<6> The gold alloy according to any one of <1> to <3>, wherein, in the compositional formula, a and b further satisfy the following (3):

$$\text{at \% ratio } (a:b) \text{ of } a \text{ to } b = 8 \text{ to } 9.5:7 \quad (3).$$

<7> A method for producing the gold alloy according to any one of <1> to <6>, the method comprising a step of melting Au, at least one atom selected from the group consisting of Al, Ga, In, Si, Ge, and Sn, and one rare-earth element in an inert atmosphere.

Advantageous Effects of Invention

According to an embodiment of the present disclosure, there is provided a gold alloy having a high gold purity and a high hardness. According to another embodiment of the present disclosure, there is provided a method for producing a gold alloy having a high gold purity and a high hardness.

DESCRIPTION OF EMBODIMENTS

Figure 1:
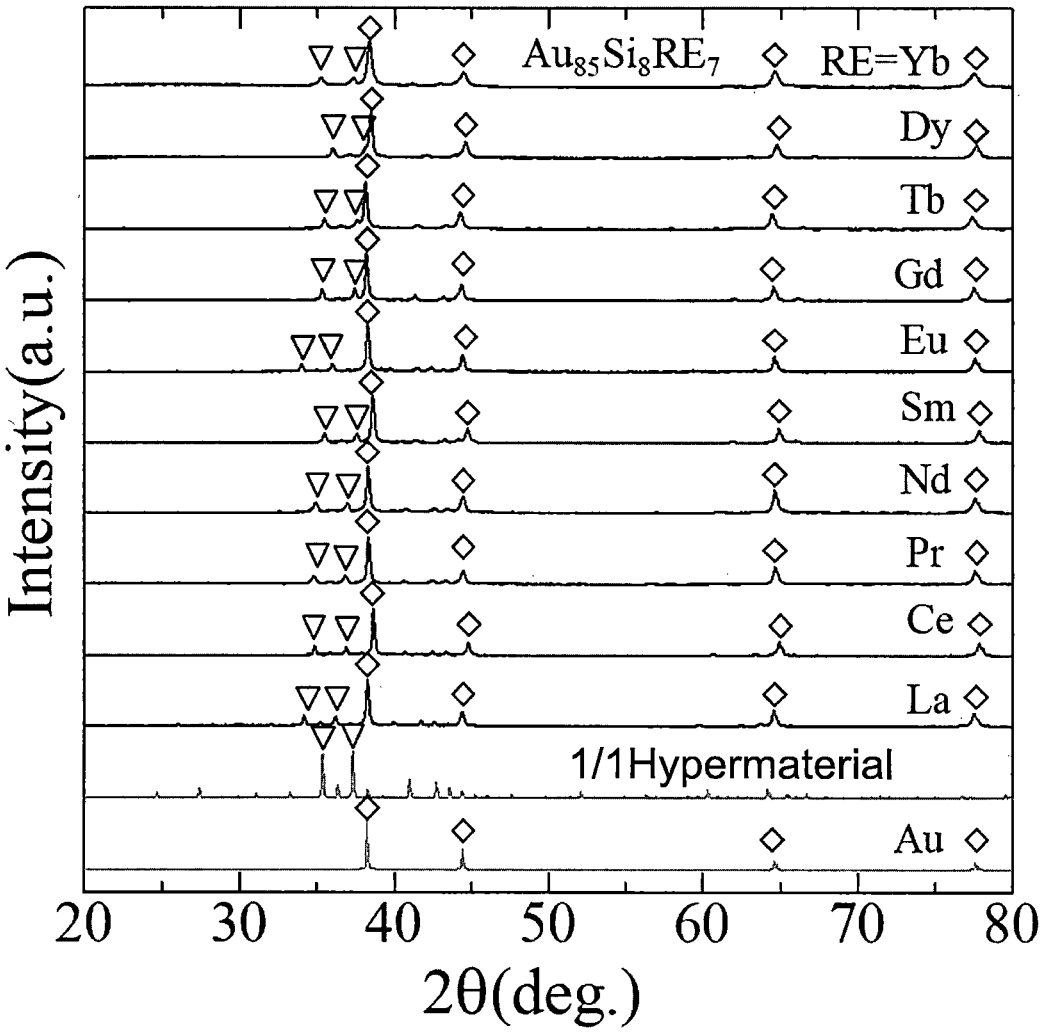
FIG. 1 shows the result of XRD diffraction of an example of a gold alloy obtained by a method for producing a gold alloy according to the present disclosure.

The contents according to the present disclosure are described in detail below. The explanation of the configuration requirements described below may be made based on representative embodiments according to the present disclosure, but the present disclosure is not limited to such embodiments.

In the present disclosure, the numerical range indicated using "to" means a range that includes the numerical values described before and after "to" as the minimum and maximum values, respectively. Regarding a numerical range described in stages in this disclosure, the upper limit value or the lower limit value described in a numerical range may be replaced by the upper limit value or the lower limit value of another numerical range described in stages. Also, regarding a numerical range described in this disclosure, the upper limit value or the lower limit value described in a numerical range may be replaced by a value shown in the Examples.

In the present disclosure, a combination of two or more preferred embodiments is a more preferred embodiment.

In the present disclosure, the term "step" encompasses not only an independent step but also a step that cannot be clearly distinguished from other steps as long as the step achieves the intended purpose of the step.

In the present specification, "gold (Au) purity" and "gold (Au) content" are synonymous. For example, "the gold purity is 95% by mass" means that the gold content with respect to the total mass of the gold-containing compound (gold alloy) is 95% by mass.

Further, in the present specification, "high hardness" means that the Vickers hardness of the obtained alloy is 100 or more.

(Gold Alloy)

The gold alloy according to the present disclosure comprises:

gold; and an Au—X-RE-based hypermaterial represented by a compositional formula $Au_{100-(a+b)}X_aRE_b$, wherein, in the compositional formula, X represents at least one atom selected from the group consisting of Al, Ga, In, Si, Ge, and Sn; RE represents a rare-earth element; and a and b respectively represent a content of X and a content of RE, expressed in at %, and satisfy the following (1) and (2):

$$10 \le a \le 40 \quad (1)$$

$$13 \le b \le 17 \quad (2)$$

wherein the Au—X-RE-based hypermaterial is dispersed in a gold matrix phase.

Due to the above-described configuration, the gold alloy according to the present disclosure has a high gold purity and a high hardness.

As described above, due to its beautiful hue, low yield, and expensiveness, gold has been used as jewelry. Pure gold (so-called 24K, having a gold content of 99.99% by mass), having a hardness (Vickers hardness) of about 20 HV to 30 HV, is excessively soft and easily scratched. Also, when pure gold is intended to be processed as jewelry, it is difficult to process the gold into a thin shape such as a gold wire. In contrast, for example, carbon steel SS400, which is a structural steel material, has a hardness (Vickers hardness) of about 130 HV to 140 HV and is excellent in processability, and thus is widely used in building structures, machines, and the like.

In general, as a method of strengthening gold, a solid solution strengthening method is known in which solute atoms (for example, Ag, Cu, or the like) are incorporated into a gold matrix phase as solid solution. However, in the solid solution strengthening method, it is possible to increase the hardness of the gold, while there is a concern that the gold purity may be decreased by mixing other elements thereinto.

Thus, in the case of obtaining a gold alloy having a high added value, a high gold purity, and a hardness to such a degree as to be excellent in processability (preferably a hardness of low carbon steel, more preferably a hardness of steel material) are required.

The inventors have made intensive studies and found that it is possible to obtain a gold alloy having increased hardness without decreasing the gold purity by dispersing a hypermaterial having a specific composition in a gold matrix phase.

The detailed mechanism in which the above effect is obtained is unclear, but is inferred as follows.

Hypermaterial is one type of intermetallic compounds, and it is generally known that dislocation hardly moves in an intermetallic compound, and an intermetallic compound has high hardness. In particular, hypermaterial is crystals having more than hundreds of atoms in a unit cell, and in addition to being an intermetallic compound, this complicated long-period structure is believed to be a factor for indicating high hardness.

Further, since the Au-based hypermaterial contains a large amount of Au in the crystal structure, it is possible to suppress a decrease in Au concentration when dispersing the Au-based hypermaterial in the gold matrix phase.

Furthermore, since the gold alloy according to the present disclosure includes the hypermaterial, having a higher hardness than the gold matrix phase, dispersed therein, the gold alloy has high hardness and excellent processability.

In the following, each configuration of the gold alloy according to the present disclosure is explained.

<Au—X-RE-Based Hypermaterial>

The Au—X-RE-based hypermaterial is a hypermaterial represented by a compositional formula $Au_{100-(a+b)}X_aRE_b$.

Here, the hypermaterial means a material group that is described in a unified manner in a high-dimensional space including a complementary space, that is, a material of a high-dimensional space (hyperspace).

The hypermaterial has a cluster structure in which atomic polyhedrons are nested. As an example of a cluster of a hypermaterial, a regular icosahedron symmetric cluster in a Tsai-type Au—X-RE-based hypermaterial is shown below. However, the present disclosure is not limited thereto.

Figure 6:
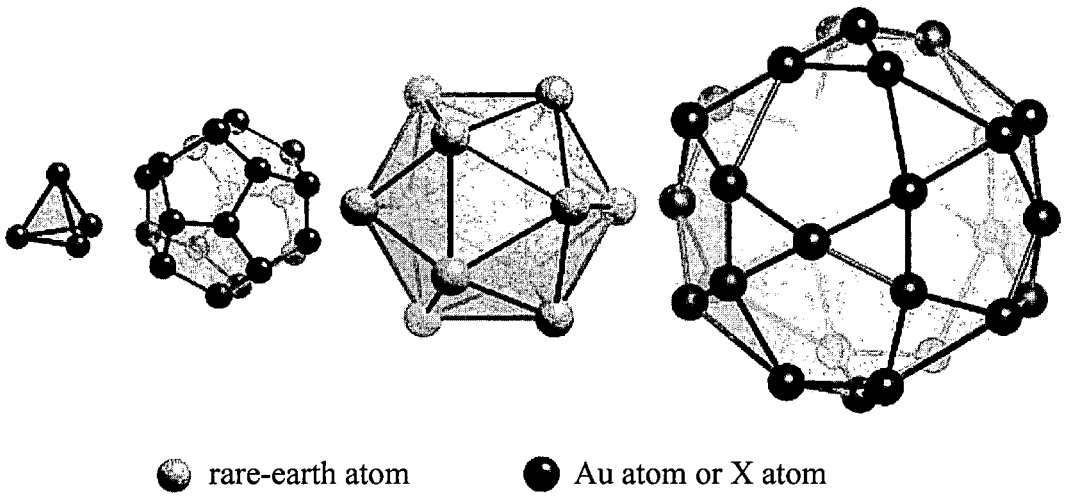
FIG. 6 shows a cluster structure of Au—X-RE-based Tsai-type hypermaterial.

In the Tsai-type Au—X-RE-based hypermaterial, the innermost shell (shown at the left end in FIG. 6) is a tetrahedron consisting of Au or X atoms, and the outer side thereof is surrounded by a second shell of a regular dodecahedron consisting of Au or X atoms (shown in the second from the left in FIG. 6). Further, the outer side thereof is surrounded by a third shell of a regular icosahedron consisting of a rare-earth element (corresponding to RE in the compositional formula) (shown in the second from the right in FIG. 6), which is surrounded by the outermost shell, which is an icosidodecahedron consisting of 30 Au and X atoms (dodeca-icosahedron) (shown at the right end in FIG. 6). Such a cluster configured by a concentric arrangement of quadruple shells is referred to as a Tsai-type cluster.

Cluster Structure of Au—X-RE-Based Tsai-Type Hypermaterial (See FIG. 6).

Specific examples of the hypermaterial include a quasi-crystal and an approximant crystal.

Here, the quasi-crystal means a compound having an ordered structure over a long distance (typically having a five-fold symmetry) but not having a translational symmetry structure, which is a feature of a regular crystal. As a composition that generates a quasi-crystal, Al—Pd—Mn, Al—Cu—Fe, Cd—Yb, Mg—Zn—Y, and the like have been known thus far. Due to its unique structure, the quasi-crystal has a variety of unique properties, including high hardness, high melting point, low coefficient of friction, and the like, as compared to a crystalline intermetallic compound having a similar composition.

The approximant crystal means a crystalline compound having a complicated structure derived from a quasi-crystal, having a partial structure similar to that of the quasi-crystal, and having properties similar to those of the quasi-crystal.

The Au—X-RE-based hypermaterial dispersed in the gold alloy can be confirmed by XRD (X-ray diffraction) measurement.

Specifically, the sample may be measured using a powder X-ray diffractometer (MiniFlex 600, manufactured by RIGAKU CORPORATION, X-ray source: CuKα), and the peak waveform of the resultant XRD may be checked against the hypermaterial-specific peak (the peak of the known quasi-crystal or approximant crystal).

<Compositional Formula $Au_{100-(a+b)}X_aRE_b$>

[X]

In the compositional formula, X represents at least one atom selected from the group consisting of Al, Ga, In, Si, Ge, and Sn.

The compositional formula may include only one X or two or more X's. Examples of the compositional formula in which X includes two or more atoms include a compositional formula represented by Au—Al—Ga—Gd or the like.

From the viewpoint of increasing the gold purity in the gold alloy, X includes preferably at least one atom selected from the group consisting of Al, Ga, Si, Ge, and Sn, is more preferably Al, Ga, Si, Ge, or Sn, is still more preferably Al, Ga, Si, or Ge, and is particularly preferably Si or Ge.

[RE]

In the compositional formula, RE represents a rare-earth element. Examples of the rare-earth element include, but are not limited to, Sc, Y, La, Ce, Pr, Nd, Pm, Sm, Eu, Gd, Tb, Dy, Ho, Er, Tm, Yb, and Lu.

Among these, RE is preferably La, Ce, Pr, Nd, Sm, Eu, Gd, Tb, Dy, or Yb, and more preferably La, Ce, Pr, Nd, or Sm, from the viewpoint of increasing the gold purity in the gold alloy.

From the viewpoint of obtaining a gold alloy having a high gold purity and a high hardness, X includes preferably at least one atom selected from the group consisting of Al, Ga, Si, Ge, and Sn (is more preferably Al, Ga, Si, Ge, or Sn, is still more preferably Ga, Si, or Ge, and is particularly preferably Si or Ge); and RE is preferably La, Ce, Pr, Nd, Sm, Eu, Gd, Tb, Dy, or Yb (more preferably La, Ce, Pr, Nd, or Sm).

From the viewpoint of obtaining a gold alloy having a high gold purity and a high hardness, when X is Si, RE is preferably La, Ce, Pr, Nd, Sm, Eu, Gd, Tb, Dy, or Yb, among which RE is more preferably a rare-earth element having a smaller atomic number, and is preferably La, Ce, Pr, Nd, or Sm.

From the viewpoint of obtaining a gold alloy having a high gold purity and a high hardness, when X is Ge, RE is preferably La, Pr, Nd, Sm, Eu, or Gd, among which RE is more preferably a rare-earth element having a smaller atomic number, and is preferably La, Ce, Pr, Nd, or Sm.

In the compositional formula, a and b respectively represent a content of X and a content of RE, expressed in at %, and satisfy the following (1) and (2). By dispersing the hypermaterial satisfying the following (1) and (2) in the gold matrix phase, a gold alloy having a high gold purity and a high hardness can be obtained.

From the above viewpoint, in the compositional formula, a and b preferably further satisfy (3) (that is, satisfy the following (1) to (3)), and more preferably satisfy the following (1), (2) and (3').

$$10 \le a \le 40 \quad (1)$$

$$13 \le b \le 17 \quad (2)$$

$$\text{at \% ratio } (a:b) \text{ of } a \text{ to } b = 8 \text{ to } 9.5:7 \quad (3)$$

$$\text{at \% ratio } (a:b) \text{ of } a \text{ to } b = 8:7 \text{ or } 9.5:7 \quad (3')$$

"at %" means an atomic percentage.

The types of X and RE of the hypermaterial represented by the compositional formula $Au_{100-(a+b)}X_aRE_b$ contained in the gold alloy, and whether or not the above (1) and (2) are satisfied, can be confirmed using a scanning electron microscope: SEM-EDS.

Specifically, after mirror polishing an obtained gold alloy sample, the sample is observed with a SEM-EDS, and the contained element and the content thereof can be confirmed using an EDS (energy dispersive X-ray spectrometer) for a gray portion of the SEM image (a portion corresponding to the Au—X-RE-based hypermaterial).

From the viewpoint of obtaining a gold alloy having a high gold purity and a high hardness, the formula (1) is preferably $10 \le a \le 21$, and more preferably $10 \le a \le 14$.

From the viewpoint of obtaining a gold alloy having a high gold purity and a high hardness, the formula (2) is preferably $13 \le b \le 15$, and more preferably $13 \le b \le 14$.

From the viewpoint of obtaining a gold alloy having a high gold purity and a high hardness, in the compositional formula, when X is Si, it is preferred that the at % ratio (a:b)

of a to b is 8:7, and it is more preferred that the gold alloy is represented by the compositional formula $Au_{85}Si_8RE_7$.

From the viewpoint of obtaining a gold alloy having a high gold purity and a high hardness, in the compositional formula, when X is Ge, it is preferred that the at % ratio (a:b) of a to b is 9.5:7, and it is more preferred that the gold alloy is represented by the compositional formula $Au_{83.5}Ge_{9.5}RE_7$.

<Gold Content>

From the viewpoint of high added value, the gold content is preferably 80% by mass or more, more preferably 85% by mass or more, still more preferably 90% by mass or more, and particularly preferably 95% by mass or more, with respect to the total mass of the gold alloy.

<Method for Producing Gold Alloy>

The method for producing a gold alloy according to the present disclosure includes a step of melting Au, at least one atom selected from the group consisting of Al, Ga, In, Si, Ge, and Sn, and one rare-earth element in an inert atmosphere.

The method for producing a gold alloy according to the present disclosure comprises the above-described step, whereby a gold alloy having a high gold purity and a high hardness can be obtained.

The at least one atom selected from the group consisting of Al, Ga, In, Si, Ge, and Sn used in the method for producing a gold alloy according to the present disclosure and the preferred embodiment thereof are the same as X and the preferred embodiment thereof in the compositional formula $Au_{100-(a+b)}X_aRE_b$ described above.

The one rare-earth element used in the method for producing a gold alloy according to the present disclosure and the preferred embodiment thereof are the same as RE and the preferred embodiment thereof in the compositional formula $Au_{100-(a+b)}X_aRE_b$ described above.

From the viewpoint of easily obtaining a pure and good hypermaterial, each of the purities of Au, at least one atom selected from the group consisting of Al, Ga, In, Si, Ge, and Sn, and one rare-earth element (hereinafter simply referred to as "raw materials" in some cases) used in the method for producing a gold alloy according to the present disclosure is preferably 99% by mass or more, more preferably 99.9% by mass or more, and still more preferably 99.99% by mass.

The shape of Au is not particularly limited and may be foil-like, plate-like, or the like.

The shape of each of the at least one atom selected from the group consisting of Al, Ga, In, Si, Ge, and Sn, and the rare-earth element is not particularly limited and can be selected as appropriate. The shape may be granular, foil-like, plate-like, massive, or the like.

When the shape of the raw materials is granular (grain), 1 mm to 8 mm is preferred, and 2 mm to 5 mm is more preferred.

As long as the respective raw materials are melted in an inert atmosphere, the method of melting the raw materials is not particularly limited, but is preferably arc-melting from the viewpoint of easy melting.

The arc-melting is carried out preferably in an inert atmosphere such as helium, argon, or nitrogen, and more preferably in an argon-substituted inert atmosphere.

From the viewpoint of preventing oxidation, in the method for producing a gold alloy according to the present disclosure, it is preferable to carry out arc-melting in an argon inert atmosphere after being placed into a vacuum atmosphere.

The arc-melting can be carried out using a vacuum arc-melting device. Specifically, the arc-melting can be carried out by placing samples prepared as materials for feeding respective elements on a same water-cooled copper hearth, carrying out vacuuming to a predetermined pressure, and applying a desired current value in an inert gas atmosphere.

The pressure during arc-melting can be adjusted to a range of, for example, $1\times10^{-2}$ Pa or less, and preferably $1\times10^{-3}$ Pa or less by vacuuming. For example, after vacuuming, arc-melting can be carried out, for example, under an inert gas of 0.01 MPa to 0.1 MPa.

The current value applied during arc-melting is preferably adjusted to a range of, for example, 20 A (ampere) to 100 A. The application time of the voltage may be selected, as appropriate, according to the case, and for example, a voltage application of 5 seconds to 30 seconds may be carried out, for example, four times.

The method for producing a gold alloy according to the present disclosure may include steps other than the above steps (other steps) as needed.

Other steps may include a step of preparing the raw materials, a step of purifying the obtained gold alloy, and the like.

EXAMPLES

Hereinafter, the present disclosure is more specifically described by way of examples. The present disclosure is not limited in any way by these examples.

Example 1

(1) As a gold (Au) raw material, an Au plate (shape: indefinite shape, purity: 99.99%) manufactured by KATAGIRI KIKINZOKU KOGYO. INC was prepared.

As one of the raw materials of the Au—X-RE-based hypermaterial (X in the compositional formula), Ge grains (shape: grains, 2 mm to 5 mm, purity: 99.99%) manufactured by KOJUNDO CHEMICAL LAB. CO., LTD. as a germanium (Ge) raw material, and Si grains (shape: grains, purity: 99.999%) manufactured by KOJUNDO CHEMICAL LAB. CO., LTD. as a silicon (Si) raw material, were prepared.

As a rare-earth element (RE in the compositional formula), respective grains (shape: indefinite-shape mass, 5 mm to 10 mm, purity: 99.9%, packed in oil) manufactured by NIPPON YTTRIUM CO., LTD. were prepared as raw materials of lanthanum La, cerium Ce, praseodymium Pr, neodymium Nd, samarium Sm, europium Eu, gadolinium Gd, terbium Tb, dysprosium Dy, and ytterbium Yb.

(2) The La, Ce, Pr, Nd, Sm, Eu, Gd, Tb, Dy, and Yb materials were placed together with acetone manufactured by GODO CO., LTD. in a beaker (B-100SCI, manufactured by HARIO CO., LTD.), and washed for 10 minutes using an ultrasonic washer (Au-16 C, manufactured by AIWA MEDICAL INDUSTRY CO., LTD.) in order to remove oil.

(3) Each of the Au, Ge, Si, La, Ce, Pr, Nd, Sm, Eu, Gd, Tb, Dy, and Yb materials was cut into a size of 1 mm to 3 mm×1 mm to 3 mm using a nipper (TESKYU-260TYPE, manufactured by ENUSHIKI CO. LTD., or N-31, manufactured by HOZAN TOOL INDUSTRIAL CO., LTD.) to prepare samples.

(4) Each of the samples obtained in the above (3) was weighed so that each of the resulting gold alloys satisfied the compositional formula $Aus_{3.5}Ge_{9.5}RE_7$ (wherein RE represents La, Ce, Pr, Nd, Sm, Eu, or Gd, and each number represents at %; the same applies hereinafter) or the compositional formula $Au_{85}Si_8RE_7$ (wherein RE represents La, Ce, Pr, Nd, Sm, Eu, Gd, Tb, Dy, or Yb, and each number represents at %; the same applies hereinafter), and so that the total mass was 1 g, to prepare 17 types of mixed samples.

(5) Subsequently, using an ultra-small vacuum arc-melting device (NEV-AD03 type, manufactured by NISSHIN GIKEN CO., LTD.), each mixed sample weighed as described above was placed on a water-cooled copper hearth, and vacuumed for about 2 hours to reach a pressure of $3\times10^{-3}$ Pa, and then the current value was adjusted to about 40 A to 80 A under an argon atmosphere to arc-melt each mixed sample.

In this case, in order to uniformly melt the mixed sample, after the sample was subjected to arc irradiation, a process in which the mixed sample was inverted using an inverting rod and then again subjected to arc irradiation was carried out twice. As a result, 17 types of spherical alloy samples having a diameter of 4 mm to 7 mm: $Au_{83.5}Ge_{9.5}RE_7$ (RE=La, Ce, Pr, Nd, Sm, Eu, or Gd) and $Au_{85}Si_8RE_7$ (RE=La, Ce, Pr, Nd, Sm, Eu, Gd, Tb, Dy, or Yb) were obtained.

(6) Each of the obtained alloy samples was cut with an Isomet (manufactured by BUEHLER LTD.).

(7) Using a polishing table (Doctor Wrap, manufactured by MARUTO INSTRUMENT CO., LTD.) and abrasive paper (Carbomac Paper, manufactured by REFINE TEC LTD.), the cut sample was polished step-by-step in the order of grain size of P800, 1000 and 2000, to prepare a mixed sample in which the top and bottom faces were parallel. Further, a few drops of diamond suspension (MetaDi™ Supreme Polycrystalline Diamond Suspension, manufactured by BUEHLER LTD.) were applied to abrasive paper (TriDent Polishing Cloth, manufactured by BUEHLER LTD.), and the alloy sample was mirror polished in the order of diamond size of 3 μm and 1 μm.

<Evaluation by X-Ray Diffraction>

(8) The mirror polished alloy samples were evaluated using a powder X-ray diffractometer (MiniFlex 600, manufactured by RIGAKU CORPORATION, X-ray source: CuKα).

Figure 2:
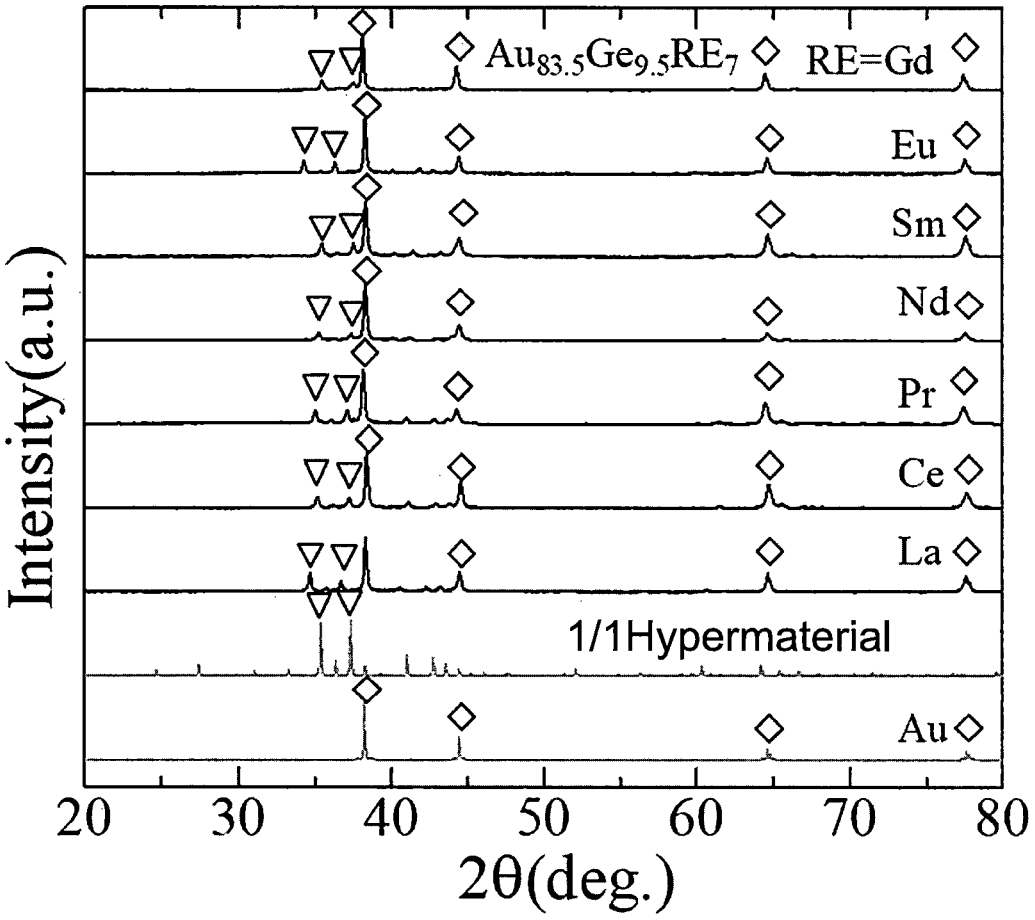
FIG. 2 shows the result of XRD diffraction of an example of a gold alloy obtained by a method for producing a gold alloy according to the present disclosure.

FIGS. 1 and 2 shows the XRD (X-ray diffraction) patterns. As shown in FIGS. 1 and 2, it can be seen that Au—X-RE-based hypermaterial-specific peaks and Au-specific peaks can be confirmed in any alloy sample compositions.

In this regard, 1/1 hypermaterial is described as a crystal structure that has a body-centered cubic structure in which Tsai-type clusters are placed at the respective vertices and the center of the cube, and that has an Im-3 symmetry.

As shown in FIGS. 1 and 2, it can be seen that a two-phase alloy of Au—X-RE-based hypermaterial and gold was successfully produced with $Au_{83.5}Ge_{9.5}RE_7$ (RE=Gd, Eu, Sm, Nd, Pr, Ce, or La) and $Au_{85}Si_8RE_7$ (RE=Yb, Dy, Tb, Gd, Eu, Sm, Nd, Pr, Ce, or La).

<Evaluation by SEM>

(9) Again, the alloy sample was polished step-by-step in the order of grain size P 1000, 2000, and 4000 with the polishing table and abrasive paper shown in (7). A few drops of diamond suspension were applied to the abrasive paper TriDent, and the alloy sample was mirror polished in the order of diamond size of 3 μm and 1 μm. A few drops of alumina suspension (MasterPrep™ Polishing Suspension 0.05 μm) were applied to abrasive paper (MasterTex Polishing Cloth, manufactured by BUEHLER LTD.), and the alloy sample was mirror polished.

(10) The alloy sample obtained in (9) was evaluated using a scanning electron microscope: SEM-EDS (JSM-IT 100, manufactured by JEOL LTD.).

Figure 3:
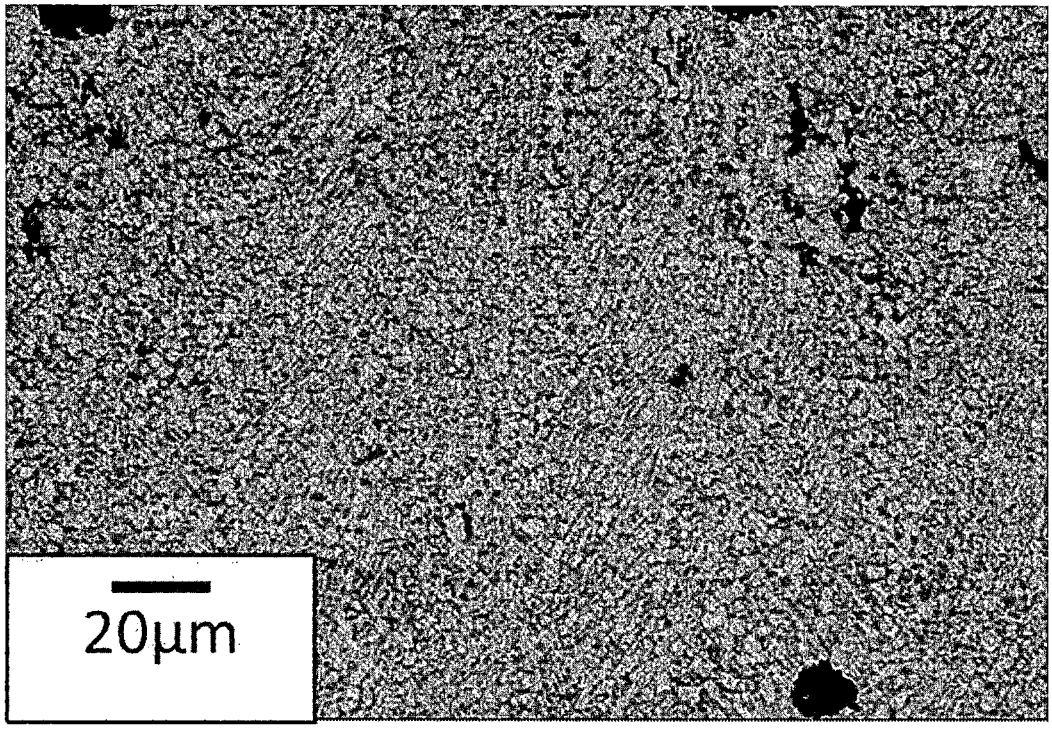
FIG. 3 is an example of SEM photograph of an example of a gold alloy obtained by a method for producing a gold alloy according to the present disclosure.

The result is shown in FIG. 3. In FIG. 3, the white portions are Au and the gray portions are the Au—X-RE-based hypermaterial. It can be seen from FIG. 3 that the Au—X-RE-based hypermaterial is dispersed in the gold matrix phase.

In this regard, when EDS analysis was carried out for the hypermaterial (Au—Ge—La) contained in the obtained gold alloy, Au was 74 at %, Ge was 13 at % (a in the compositional formula), La was 13 at % (b in the compositional formula), and the hyper material (Au—Ge—La) satisfied formula (1) and formula (2).

<Hardness>

Figure 4:
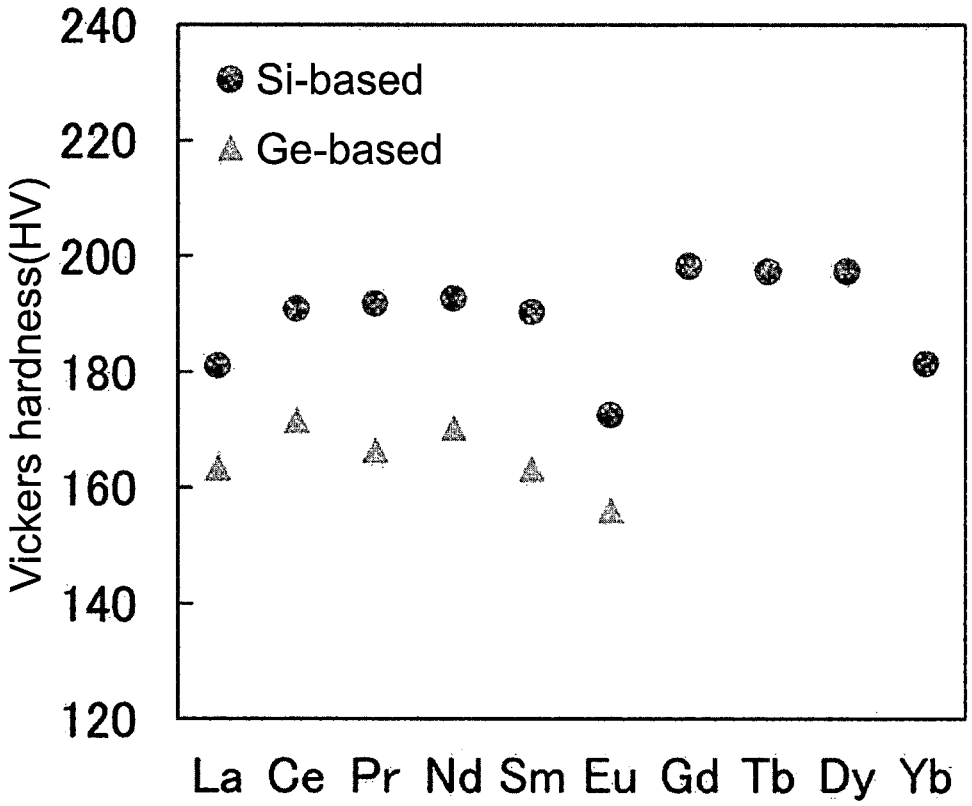
FIG. 4 is a graph showing the relationship between the rare-earth element included in an example of a gold alloy obtained by a method for producing a gold alloy according to the present disclosure and the Vickers hardness of the gold alloy.

(11) The micro-Vickers hardness of each alloy sample was measured and evaluated using a SHIMADZU microhardness tester (HMV-G21, manufactured by SHIMADZU CORPORATION). The results are shown in FIG. 4 and Table 1.

Each alloy sample had a Vickers hardness of more than 156 HV.

TABLE 1

| | Vickers hardness (HV) | |
|---|---|---|
| RE | $Au_{85}Si_8Re_7$ | $Au_{83.5}Ge_{9.5}Re_7$ |
| La | 181 | 163 |
| Ce | 191 | 172 |
| Pr | 192 | 166 |
| Nd | 193 | 170 |
| Sm | 191 | 163 |
| Eu | 173 | 156 |
| Gd | 198 | |
| Tb | 197 | |
| Dy | 197 | |
| Yb | 182 | |

Example 2

(12) Each of the materials prepared in Example 1 was weighed so that each of the resulting gold alloys satisfied a compositional formula $Au_xGe_yLa_z$ (x=81.2, 86.0, 91.3, or 97 at %, y:z=9.5:7 (at % ratio)) or $Au_xSi_yCe_z$ (x=87 or 89 at %, y:z=8:7 (at % ratio), and so that the total mass was 1 g, to prepare 6 types of mixed samples.

(13) Arc-melting was carried out under the same condition as in (5) of Example 1, except that the 6 types of mixed samples prepared above were used, to obtain alloy samples.

(14) The alloy samples obtained in (13) were cut, polished, and mirror polished under the same conditions as in (6), (7), and (8) of Example 1, and then X-ray diffraction measurement was carried out.

(15) Mirror polishing was carried out again under the same condition as in (7) of Example 1, and then the material structure was evaluated using SEM-EDS.

Figure 5:
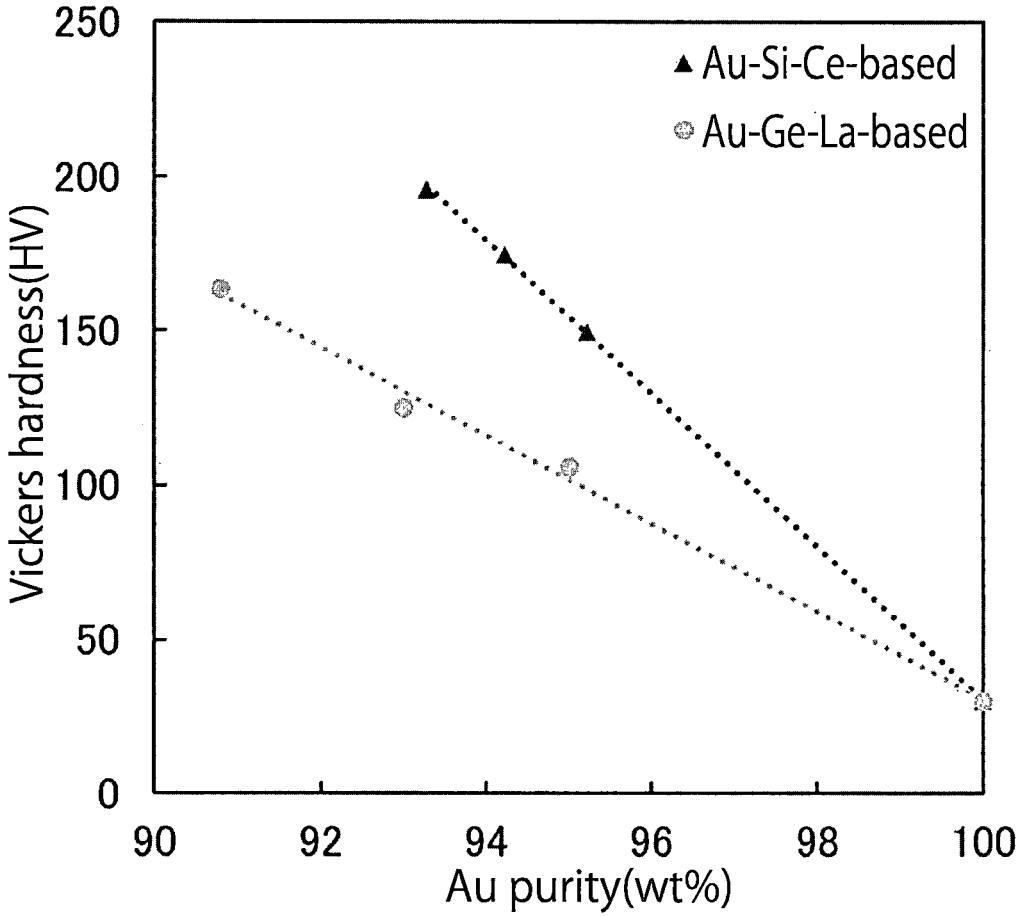
FIG. 5 is a graph showing the relationship between the Au purity of an example of a gold alloy obtained by a method for producing a gold alloy according to the present disclosure and the Vickers hardness of the gold alloy.

(16) The micro-Vickers hardness was measured under the same condition as in (11) of Example 1. The results are shown in FIG. 5.

The area of Vickers hardness of 130 HV to 140 HV indicates a hardness suitable for rolling, wire drawing, and the like (that is, a hardness excellent in processability), which is an ideal hardness for a jewelry material.

In this regard, pure gold (having a gold purity of 99.99%) has a Vickers hardness of 20 HV to 30 HV.

It can be seen that, in each of the gold alloy in which the Au—Ge—La-based hypermaterial are dispersed and the gold alloy in which the Au—Si—Ce-based hypermaterial are dispersed, produced in Example 2, the gold purity and the hardness are in a linear relationship, and the hardness varies linearly with the amount of the dispersed hypermaterial. Further, the gold alloy in which the Au—Si—Ce-based hypermaterial was dispersed had a Vickers hardness of 145 HV to 200 HV in the range of the gold purity of 93% by mass to 96% by mass.

As shown in Examples 1 and 2, it can be seen that, in the method for producing a gold alloy according to the present disclosure and the gold alloy obtained by the method, the gold purity is high and the hardness is high.

Further, it has been found that the Au—Ge—La-based gold alloy and the Au—Si—Ce-based gold alloy can achieve a desired hardness with an extremely high gold purity (gold content) of 93.1% by mass and 95.9% by mass, respectively. This is a higher purity than 18K (Au content: 75% by mass), which has been commonly used as jewelry thus far.

The gold alloy and the method for producing the same according to the present disclosure are the results of Grants-in-Aid for Scientific Research of Japan Society for the Promotion of Science: Innovative Areas (Research in a Proposed Research Area) "Hypermaterials: Innovation of materials science in hyper space" (Project Numbers: 19H05817 and 19H05818, in 2019-2023).

The disclosure of Japanese Patent Application No. 2021-056093 filed on Mar. 29, 2021 is incorporated herein by reference in its entirety.

All documents, patent applications, and technical standards described in this specification are incorporated herein by reference to the same extent as if each individual document, patent application, or technical standard was specifically and individually indicated to be incorporated by reference.

The invention claimed is:

1. A two-phase gold alloy, comprising:

a gold matrix phase; and an Au—X-RE-based hypermaterial phase that is dispersed in the gold matrix phase and that is represented by a compositional formula $Au_{100-(a+b)}X_aRE_b$, wherein, in the compositional formula, X represents at least one atom selected from the group consisting of Ga, In, Si, Ge, and Sn; RE represents a rare-earth element; and a and b respectively represent a content of X and a content of RE, expressed in at %, and satisfy the following (1) and (2):

$$10 \leq a \leq 40 \quad (1)$$

$$13 \leq b \leq 17 \quad (2).$$

2. The gold alloy according to claim 1, wherein an Au content is 80% by mass or more with respect to a total mass of the gold alloy.

3. The gold alloy according to claim 1, wherein the rare-earth element is Sc, Y, La, Ce, Pr, Nd, Sm, Eu, Gd, Tb, Dy, or Yb.

4. A method for producing the gold alloy according to claim 1, the method comprising melting Au, at least one atom selected from the group consisting of Ga, In, Si, Ge, and Sn, and one rare-earth element in an inert atmosphere.

5. A gold alloy, comprising:

gold; and an Au—X-RE-based hypermaterial represented by a compositional formula $Au_{100-(a+b)}X_aRE_b$, wherein, in the compositional formula, X represents at least one atom selected from the group consisting of Ga, In, Si, Ge, and Sn; RE represents a rare-earth element; and a and b respectively represent a content of X and a content of RE, expressed in at %, and satisfy the following (1) and (2):

$$10 \leq a \leq 40 \quad (1)$$

$$13 \leq b \leq 17 \quad (2)$$

wherein the Au—X-RE-based hypermaterial is dispersed in a gold matrix phase, and wherein the rare-earth element is Sc, Y, La, Ce, Pr, Nd, Pm, Sm, Eu, Tb, Dy, Ho, Er, Tm, or Lu.

6. The gold alloy according to claim 5, wherein an Au content is 80% by mass or more with respect to a total mass of the gold alloy.

7. The gold alloy according to claim 5, wherein the rare-earth element is Sc, Y, La, Ce, Pr, Nd, Sm, Eu, Tb, or Dy.

8. A method for producing the gold alloy according to claim 5, the method comprising melting Au, at least one atom selected from the group consisting of Ga, In, Si, Ge, and Sn, and one rare-earth element that is Sc, Y, La, Ce, Pr, Nd, Pm, Sm, Eu, Tb, Dy, Ho, Er, Tm, or Lu in an inert atmosphere.

* * * * *